United States Patent [19]

Lichka

[11] Patent Number: 4,927,045

[45] Date of Patent: May 22, 1990

[54] SYSTEM OF SAFETY TANK ELEMENTS PREVENTING EXPLOSIONS

[75] Inventor: Helmut J. Lichka, Vienna, Austria

[73] Assignee: Technolizenz Establishment, Triesen, Liechtenstein

[21] Appl. No.: 289,481

[22] Filed: Dec. 21, 1988

Related U.S. Application Data

[63] Continuation of Ser. No. 713,727, filed as PCT AT 84/00022 on Jun. 18, 1984, published as WO85/00113 on Jan. 17, 1985, abandoned.

[30] Foreign Application Priority Data

Jun. 27, 1983 [AT] Austria ..... 2342/83

[51] Int. Cl.[5] ..... B65D 25/00

[52] U.S. Cl. ..... 220/88 R

[58] Field of Search ..... 220/88 R, 85 S, 5 A

[56] References Cited

U.S. PATENT DOCUMENTS

| | | | |
|---|---|---|---|
| 2,305,923 | 12/1942 | Held | 220/88 R |
| 3,069,042 | 12/1962 | Johnston | 220/88 R |
| 3,322,294 | 5/1967 | Nemeth | 220/88 R X |
| 3,349,953 | 10/1967 | Conway et al. | 220/85 |
| 3,356,256 | 12/1967 | Szego | 220/88 R X |
| 3,650,431 | 3/1972 | Stewart | 220/88 R |
| 3,708,330 | 1/1973 | Harr | 220/88 R X |
| 3,822,807 | 7/1974 | MacDonald et al. | 220/88 R |
| 3,979,005 | 9/1976 | Robinson et al. | 220/5 A X |
| 4,013,190 | 3/1977 | Wiggins et al. | 220/88 R X |
| 4,134,491 | 1/1979 | Turillon et al. | 220/88 R X |
| 4,248,342 | 2/1981 | King et al. | 220/88 R X |
| 4,294,279 | 10/1981 | Wyeth | 220/85 S X |
| 4,566,589 | 1/1986 | Poschinger | 220/88 R X |
| 4,613,054 | 9/1986 | Schrenk | 220/88 R |

*Primary Examiner*—Steven M. Pollard

*Attorney, Agent, or Firm*—Flynn, Thiel, Boutell & Tanis

[57] ABSTRACT

Explosion-preventing tank safety elements (TSE) are provided for filling containers for explosible fluid and gas media while avoiding enlarging, transforming, cutting or welding the tanks. The loading of the elements is possible simply through the filling pipe or outlet opening of each container.

21 Claims, 1 Drawing Sheet

2
3

2
3

3
5
2

2
3

6
1
2

7

2
3

2
3

2
3

SYSTEM OF SAFETY TANK ELEMENTS PREVENTING EXPLOSIONS

This application is a continuation of U.S. Ser. No. 713,727, filed as PCT AT84/00022 on Jun. 18, 1984, published as WO85/00113 on Jan. 17, 1985, now abandoned.

FIELD OF THE INVENTION

The invention relates to fill elements for containers for explosible fluids which have at least one inlet or outlet opening, for the creation of a heat-conducting or electrically conducting structure in space.

BACKGROUND OF THE INVENTION

Particularly from U.S. Pat. No. 3,356,256, the suggestion has become known to include in containers for explosible fluids a spatial metal grid which prevents local overheating by rapidly conducting away heat and thus making the container explosion-proof. In the known device, the needed grid is constructed of layers of metal mesh rolled up like balls of cloth and introduced during the manufacture of the tank into same. The necessity to provide the tank with an explosion-proof safety device or, however, to cut it open to insert the metal grid and to then re-assemble it has the result that the mentioned suggestion was hardly practical so far. Mainly, it was not possible to protect gas containers or gas bottles against explosions by a heat-conducting, spacial metal grid, since here an insertion of the grid during the manufacture would be difficult and a subsequent insertion would not at all be permissible due to the partial destruction of the container.

SUMMARY OF THE INVENTION

The primary goal of the invention is to make all types of containers for explosible liquids or gases explosion-proof without opening or even removing the container, for example without removing it from a vehicle.

This goal is achieved by the dimensions of the fill elements exceeding in at most one direction the diameter of the largest opening of the container. In this manner, it is possible to insert the fill elements subsequently into the finished container, which thus represents the basic concept of the invention.

The inventive fill elements can be made of various materials which on one hand assure a quick heat conduction or electrostatic conduction and on the other hand give the elements a structure which makes it possible to divide the tank interior into small areas with only a slight loss of usable volume.

Aside from aluminum, in particular anodized aluminum, stainless steel or tin foil can be used; for the better chemical stabilization it is possible to coat these metals with galvanic layers. However, it is also possible to use plastics like polyurethane or polysulphone as long as their conductivity is increased sufficiently, for example by adding graphite.

The plastic parts can thereby be produced by injection molding, cutting, casting or stamping techniques.

Basically, many different shapes of fill elements can be used for carrying out the concept of the invention. The elements, which are inserted through the inlet or outlet opening of the container, which remains installed, must occupy at least the whole free gas volume of the tank, and thus not be appreciably compressed under the influence of movements of the tank contents and of fill elements which lie thereabove. On the other hand, adjacent fill elements must touch each other along their adjacent portions at sufficiently many places so that there does not occur an interruption of the heat conduction or electrical conduction and thus a reduced explosion protection.

In spite of the principally existing possibility to construct the fill elements totally different, it is particularly advantageous if the fill elements are provided with a plurality of diverging plates. It is possible in this case to insert the brushlike fill elements through an inlet opening, even if they have to be compressed temporarily during the insertion. This is particularly important during the loading of gas containers with a narrow opening. The platelike fill elements assume again their original shape inside of the container; they penetrate through one another in their areas close to the surface, whereby their mutual approach is limited to the necessary degree. In particular, for cube-shaped containers, it is possible to introduce a single large brushlike cell utilizing its elasticity, which then fills the entire container interior. It is easily possible to achieve on the one hand by, adjusting the number and dimension of the plates, the necessary heat bridges or electrically conducting chains between the fill elements, while on the other hand the total liquid or gas volume which is displaced by the fill elements remains in the order of magnitude of approximately 1.7%–3% of the container volume.

Rolling movements due to mass inertia are suppressed by the elements.

Even though the use of fill elements with diverging bunches of plates is advantageous, in that such dry cells can be introduced through inlet openings which can only be passed through deformation of the bunches, other cell shapes can by all means also be used according to the invention. In as far as metal elements are used, particular attention was given here to shape these through a suitable folding, which on the one hand assures mutual contact of the elements at as many points as possible, and on the other hand prevents their collapsing at the bottom of the container. The number of geometrical shapes which are possible in this sense is practically unlimited, since thin metal plates can be connected with one another, nested into one another, folded in a zig-zag shape, or constructed spiral-shaped. Also, spherical shapes which are created by forming balls of foil can be used, as long as the foil is sufficiently perforated in order not to prevent the filling of the container with fluid.

An important additional difference relates to whether the fill elements are introduced into the container as individual pieces or in continuous strips. If the elements consist substantially of a plastic foam, they will generally be inserted in the form of small balls or cubes. Whereas, in particular, the previously mentioned bunches of plates are arranged in a practical manner on one or several wires and are introduced on same continuously into the container.

For example, the safety element which is based on a center axis formed by one or two wires can be produced in such a size that the introduction of only one large element is sufficient to ensure the safety of a fuel tank, tanker, etc. This has up to now the unrivalled advantage that the large elements can subsequently be removed quickly and easily from the tank, which is important for the cleaning of the tank.

In addition, by varying the size of the elements, custom-made and inexpensive solutions to problems can be achieved.

It is important to mention that the elements which consist of aluminum alloys and other electrically conducting materials are most suited to overcome the explosible causes of the static loading and thus also offer problem solutions in plastic tanks in order to make such tanks suitable for the transport of dangerous goods. The same effect is also valid for containers with glass-fiber reinforced plastic linings.

The tank safety elements, which are made for example of aluminum alloys, are also ideally suited for cathodic corrosion protection. They act in metal tanks as a "sacrificial anode", which means that tanks which are equipped therewith and protected in this manner cannot rust on the inside. The anodic element break-down, for example in the case of cells with a strength of 100 mμ, is so slow that the fill element life exceeds that of the tanks which are commonly used.

BRIEF DESCRIPTION OF THE DRAWING

Details of the invention will be discussed hereinafter in connection with exemplary embodiments but without limiting the invention to the illustrated embodiments.

DETAILED DESCRIPTION

Figures 1, 2, 3, 4, 5, 6, 7, 8, 9, 10, 11, 12, 13, 14, 15, 16, 17:
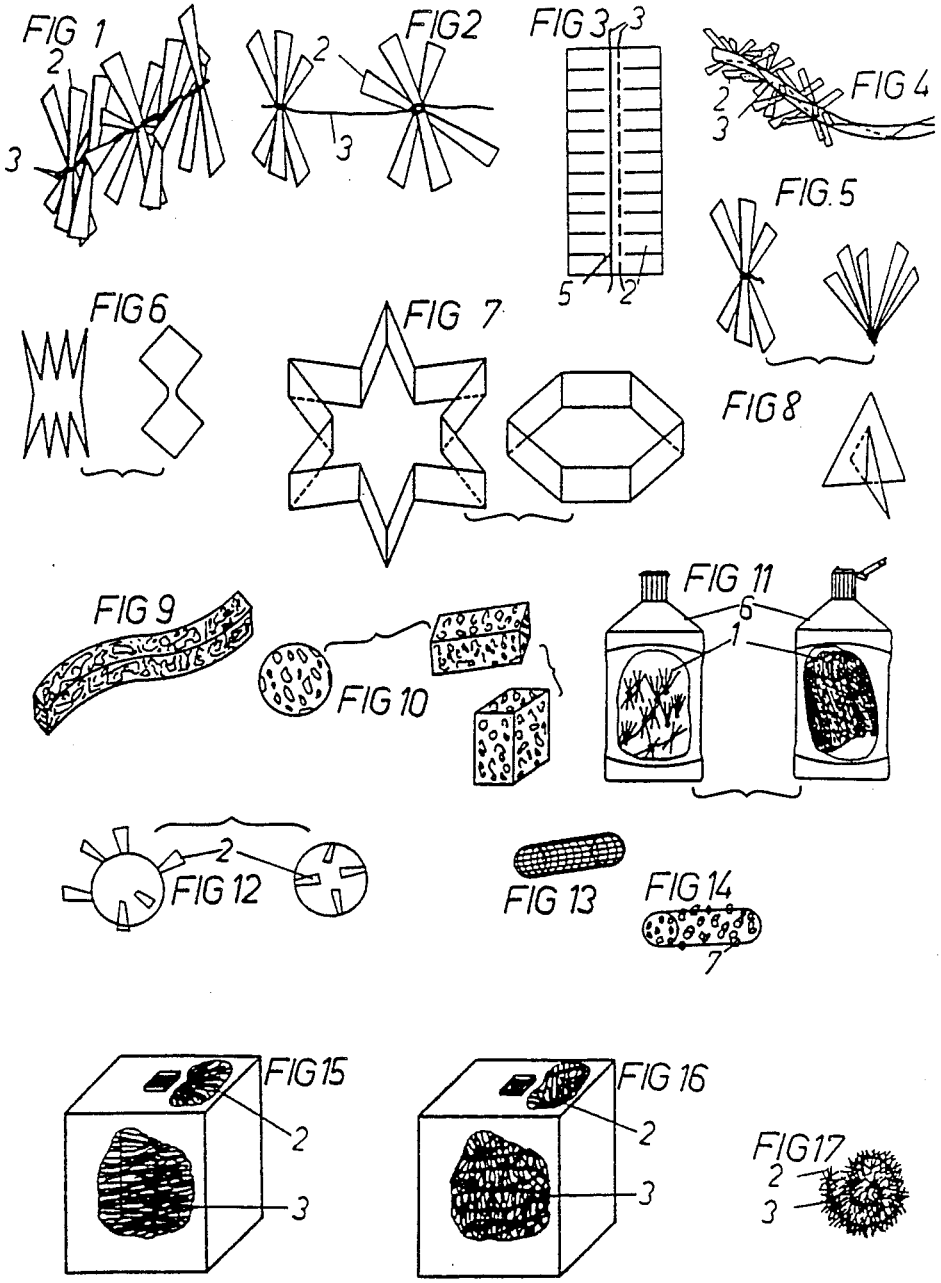
FIG. 1 is a diagrammatic illustration of an inventive fill element.
FIG. 2 illustrates a modification of the exemplary embodiment according to FIG. 1.
FIG. 3 illustrates a strip of elements with a fixedly continuous bar and with separations of the individual plates, the separations being cut into the diameter of the plates on both sides. The strip of elements is then twisted around at least one wire and has the advantage that the individual plates are very strongly secured for this and a loosening of the individual plates becomes impossible.
FIG. 4 illustrates an element which is twisted over the wires according to FIG. 3.
FIG. 5 illustrates a fill element in the form of a single bunch and a second fill element in the form of a platelike noncontinuous single bunch.
FIG. 6 illustrates various possible plate shapes.
FIG. 7 illustrates a fill element which is produced by folding and connecting a flat foil and FIG. 8 illustrates a fill element which is produced by inserting one art inside another.
FIG. 9 illustrates a striplike fill element of steel wool.
FIG. 10 illustrates a porous ball of a conducting foam and a cubic or rectangular foam element.
FIG. 11 illustrates an arrangement of fill elements in a spirit "safety bottle".
FIG. 12 illustrates symbolically hollow-spherical cells respectively having projecting and inverted plates.
FIG. 13 illustrates a tubular element made of metal gauze or screening.
FIG. 14 illustrates a tubular element made of a metal foil with pores and projecting surfaces.
FIG. 15 illustrates a cube-shaped tank having only one brush element.
FIG. 16 illustrates a cube-shaped tank with a wound element.
FIG. 17 illustrates a worm-shaped or ball-shaped rolled-up element.

The construction of the fill element which is illustrated in FIG. 1 corresponds exactly with that of a bottle brush: bunches of plates (2) are arranged spaced from one another between two wires (3) which are twisted together, which plates diverge radially from the wires (3) which support the plates (2). It is also possible to arrange the bunches of plates (2) on a single wire (4) as is illustrated in FIG. 2. While the fill elements according to FIGS. 1 and 2 are introduced into a tank or container as a continuous chain in any desired form of arrangement, the plate bunches according to FIG. 5 are intended to be thrown in individually through the container opening.

In order to achieve a greater stability of the plates, it would be possible, as is illustrated in FIGS. 3 and 4, to construct from one strip a continuous bar (5) and the plate structure could be produced by cutting on both sides into the strip, so that by twisting the strip or several strips around a wire or two wires, the plate projection can occur stable to all sides.

As is illustrated in FIG. 6, the shape of the plates can vary within a wide range, whereby the number, size and stiffness of the plates are to be chosen so that adjacent fill elements (1) have sufficient contact surfaces but do not penetrate each so far that a large additional weight due to the cell material is created or so that the usable tank capacity is substantially reduced.

The shape of the support for the plates does not by any means have to be linear. Only as an example, it is mentioned that such plates can also be arranged on metal surfaces which in turn can be constructed cylindrically or spherically (FIG. 12). In this case, it is of course necessary to have the plates project also inside of the hollow bodies which are formed by the supports, so that also from the inside of the hollow bodies there can take place a rapid heat and electrical conduction.

The embodiments according to FIG. 7 are constructed as a single cell, which, as mentioned, represents only one of many possible forms for relatively stable geometrical bodies with a small space occupancy from which the average man skilled in the art may choose.

Important for the invention is not, as mentioned, the use of new materials for the filling of the containers but the use of such materials in a shape which permits their insertion into the container. Steel wool, which has proven suitable in this respect, can be inserted for example in the form of the strips illustrated in FIG. 9, in plastic form in the shape of the balls or cubes or rectangles illustrated in FIG. 10, or also other geometrical forms. To produce the chain of conduction it is necessary that the individual cells touch one another, see for example FIG. 11.

Various types of containers can be protected by the invention against explosion only by means of the insertion of metal structures. Examples of this are plastic fuel tanks and also cube-shaped plastic containers for the transport of dangerous goods or even for example gas cylinders, where it would be impossible to insert the fill elements during the manufacturing stage. As an example for this, FIG. 11 illustrates a safety bottle (6) filled, for example, with spirits used in households to ignite a charcoal grill and which, through the insertion of inventive fill elements (1) through the opening therein, is here no longer explosive. The safety bottle (6) for grilling could, of course, also be made of plastic.

The inventive explosion-preventing elements are suited very well for all types of motor vehicles and their fuel tanks, military vehicles and for vehicles which are driven and used for other purposes, for any type of aircraft and their fuel tanks, for any type of gas tank or gas cylinder for the industrial and chemical fields, and for the household and motor vehicle field.

The embodiments of the invention in which an exclusive property or privilege is claimed are defined as follows:

1. A filler apparatus for a container which can hold an explosible fluid and which has at least one opening, comprising filler means capable of passing through the largest opening in the container for forming therein a three-dimensional structure which is at least one of thermally and electrically conductive, said filler means including a filling element having a dimension in at least one direction which, when in the interior of the container, exceeds the greatest dimension of the largest opening in the container, said filling element including a plurality of diverging elements which are elastically deformable and project from at least one support member, said diverging elements having ends remote from said support member which are free of interconnections.

2. Explosion suppression elements to be introduced into a fuel container through a fuel hole therein which communicates with an interior thereof, each of said elements comprising:

an elongate reinforced support member from which a plurality of rigid projecting members project radially;

said projecting members having ends remote from said support member which are free of interconnections;

said ends of adjacent said projecting members on each said element being spaced sufficiently from each other so as to allow the intrusion therebetween of the ends of the projecting members on a different said element;

and the maximum distance between the ends of any two said projecting members which project in substantially opposite directions from substantially the same location on one of said support members being smaller than a diameter of the fuel hole.

3. Explosion suppression elements according to claim 2, wherein said support member is of linear form.

4. Explosion suppression elements according to claim 2, wherein said support member includes at least one wire.

5. Explosion suppression elements according to claim 2, wherein at least one of said support member and said projecting members of each said element is made of a material which is at least one of thermally and electrically conductive.

6. Explosion suppression elements according to claim 2, wherein said projecting members include at least one of aluminum, aluminum-alloy, stainless steel, tinfoil, electrically conductive plastic material, and heat conductive plastic material.

7. Explosion suppression elements according to claim 2, wherein at least one of said support member and said projecting members of each said element is coated with a coating which is at least one of a stabilizing coating and an electrically deposited coating.

8. Explosion suppression elements to be introduced into a fuel container through a fuel hole therein which communicates with an interior thereof, each of said elements comprising:

an elongate reinforced support member from which a plurality of projecting members project radially a substantial distance from said support member;

said projecting members having ends remote form said support member which are free of interconnections;

said ends of adjacent said projecting members on each said element being spaced sufficiently from each other so as to allow the intrusion therebetween of the ends of the projecting members on a different said element;

and said projecting members on each said element being freely flexible with respect to said support member thereof.

9. Explosion suppression elements according to claim 8, wherein the maximum distance between the ends of any two said projecting members which project in substantially opposite directions from substantially the same location on one of said support members is larger than a diameter of the fuel hole, said projecting members flexing resiliently toward said support member while being inserted through the fuel hole.

10. Explosion suppression elements according to claim 8, wherein said support member is of linear form.

11. Explosion suppression elements according to claim 8, wherein said support member includes at least one wire.

12. Explosion suppression elements according to claim 11, wherein said support member includes at least two said wires which are twisted together and wherein said projecting members are held between said twisted wires.

13. Explosion suppression elements according to claim 12, wherein said projecting elements are wires and form a generally cylindrical brush-like arrangement.

14. Explosion suppression elements according to claim 8, wherein at least one of said support member and said projecting members of each said element is made of a material which is at least one of thermally and electrically conductive.

15. Explosion suppression elements according to claim 8, wherein said projecting members include at least one of aluminum, aluminum-alloy, stainless steel, tinfoil, electrically conductive plastic material, and heat conductive plastic material.

16. Explosion suppression elements according to claim 8, wherein at least one of said support members and said projecting members of each said element is made of an open-cell plastic foam.

17. Explosion suppression elements according to claim 8, wherein at least one of said support members and said projecting members of each said element is coated with a coating which is at least one of a stabilizing coating and an electrically deposited coating.

18. Explosion suppression elements according to claim 8, wherein at least one of said support member and said projecting members of each said element includes at least one of a textile fabric, a reinforced textile, and a non-woven material.

19. Explosion suppression elements according to claim 8, wherein said elements each include a plurality of elongate foil strips laid one on top of the other, two opposite edges of each said strip being cut to define comblike teeth therealong which are said projecting members, said foil strips being twisted around an axis extending lengthwise thereof intermediate said edges thereof so as to form a cylindrical brush-like arrangement, said strips having center portions which serve as said support member.

20. Explosion suppression elements according to claim 19, wherein said support member includes at least one wire extending lengthwise of and wrapped around said center portions of said strips to effect reinforcement thereof.

21. Explosion suppression elements according to claim 8, wherein said elements introduced into the container use 1.7% to 3% of the volume of the container.

* * * * *